US008845065B2

(12) United States Patent
Leighton et al.

(10) Patent No.: US 8,845,065 B2
(45) **Date of Patent: *Sep. 30, 2014**

(54) INKJET PRINTER HAVING AN IMAGE DRUM HEATER AND COOLER

(71) Applicant: Xerox Corporation, Norwalk, CT (US)

(72) Inventors: Roger G. Leighton, Hilton, NY (US); Michael F. Leo, Penfield, NY (US); Venkata B. Chivukula, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/217,559

(22) Filed: Mar. 18, 2014

(65) Prior Publication Data

US 2014/0198163 A1 Jul. 17, 2014

Related U.S. Application Data

(63) Continuation of application No. 13/489,669, filed on Jun. 6, 2012, now Pat. No. 8,721,024.

(51) Int. Cl.
*B41J 29/38* (2006.01)
*B41J 29/377* (2006.01)

(52) U.S. Cl.
CPC ..... *B41J 29/377* (2013.01)
USPC ..... 347/17

(58) Field of Classification Search
CPC ..... B41J 29/38; B41J 2/0057; G03G 15/751
USPC ..... 347/17, 18, 37–39, 102, 103
See application file for complete search history.

(56) References Cited

U.S. PATENT DOCUMENTS

| | | | |
|---|---|---|---|
| 5,099,256 | A | 3/1992 | Anderson |
| 5,502,476 | A | 3/1996 | Neal et al. |
| 5,507,227 | A | 4/1996 | Frazer |
| 5,532,722 | A | 7/1996 | Namiki et al. |
| 6,713,728 | B1 | 3/2004 | Justice et al. |
| 7,459,658 | B2 | 12/2008 | Hays et al. |
| 7,682,014 | B2 | 3/2010 | Snyder et al. |
| 7,725,050 | B2 | 5/2010 | Li et al. |
| 7,860,418 | B2 | 12/2010 | VanKouwenberg et al. |
| 7,971,987 | B2 | 7/2011 | Godil et al. |
| 8,721,024 | B2 * | 5/2014 | Leighton et al. ..... 347/18 |

* cited by examiner

*Primary Examiner* — An Do
(74) *Attorney, Agent, or Firm* — Maginot, Moore & Beck, LLP

(57) ABSTRACT

An inkjet offset printer includes a heated drum assembly having a hollow drum with an internal surface defining an internal cavity and a heater and a cooler located in the internal cavity. The heater includes at least one ceramic heater element. The cooler includes a slot to direct an air stream that is normal to the internal surface of the drum that aids in quenching the heating element for faster control responses.

19 Claims, 5 Drawing Sheets

INKJET PRINTER HAVING AN IMAGE DRUM HEATER AND COOLER

PRIORITY CLAIM

This application is a continuation application of and claims priority to U.S. patent application Ser. No. 13/489,669, which is entitled "Inkjet Printer Having An Image Drum Heater And Cooler," which was filed on Jun. 6, 2012, and which issued as U.S. Pat. No. 8,721,024 on May 13, 2014.

TECHNICAL FIELD

This disclosure relates generally to solid ink offset printers, and more particularly to rotating image receiving members that are heated to a temperature prior to and while receiving ink images.

BACKGROUND

Inkjet printers operate a plurality of inkjets in each printhead to eject liquid ink onto an image receiving member. The ink can be stored in reservoirs that are located within cartridges installed in the printer. Such ink can be aqueous ink or an ink emulsion. Other inkjet printers receive ink in a solid form and then melt the solid ink to generate liquid ink for ejection onto the image receiving surface. In these solid ink printers, also known as phase change inkjet printers, the solid ink can be in the form of pellets, ink sticks, granules, pastilles, or other shapes. The solid ink pellets or ink sticks are typically placed in an ink loader and delivered through a feed chute or channel to a melting device, which melts the solid ink. The melted ink is then collected in a reservoir and supplied to one or more printheads through a conduit or the like. Other inkjet printers use gel ink. Gel ink is provided in gelatinous form, which is heated to a predetermined temperature to alter the viscosity of the ink so the ink is suitable for ejection by a printhead. Once the melted solid ink or the gel ink is ejected onto the image receiving member, the ink returns to a solid, but malleable form, in the case of melted solid ink, and to a gelatinous state, in the case of gel ink.

A typical inkjet printer uses one or more printheads with each printhead containing an array of individual nozzles through which drops of ink are ejected by inkjets across an open gap to an image receiving surface to form an ink image during printing. The image receiving surface can be the surface of a continuous web of recording media, a series of media sheets, or the surface of an image receiving member, which can be a rotating print drum or endless belt. In an inkjet printhead, individual piezoelectric, thermal, or acoustic actuators generate mechanical forces that expel ink through an aperture, usually called a nozzle, in a faceplate of the printhead. The actuators expel an ink drop in response to an electrical signal, sometimes called a firing signal. The magnitude, or voltage level, of the firing signals affects the amount of ink ejected in an ink drop. The firing signal is generated by a printhead controller with reference to image data. A print engine in an inkjet printer processes the image data to identify the inkjets in the printheads of the printer that are operated to eject a pattern of ink drops at particular locations on the image receiving surface to form an ink image corresponding to the image data. The locations where the ink drops landed are sometimes called "ink drop locations," "ink drop positions," or "pixels." Thus, a printing operation can be viewed as the placement of ink drops on an image receiving surface with reference to electronic image data.

Phase change inkjet printers form images using either a direct or an offset print process. In a direct print process, melted ink is jetted directly onto recording media to form images. In an offset print process, also referred to as an indirect print process, melted ink is jetted onto a surface of a rotating member such as the surface of a rotating drum, belt, or band. Recording media are moved proximate the surface of the rotating member in synchronization with the ink images formed on the surface. The recording media are then pressed against the surface of the rotating member as the media passes through a nip formed between the rotating member and a transfix roller. The ink images are transferred and affixed to the recording media by the pressure in the nip. This process of transferring an image to the media is known as a "transfix" process. The movement of the image media into the nip is synchronized with the movement of the image on the image receiving member so the image is appropriately aligned with and fits within the boundaries of the image media.

When the image receiving member is in the form of a rotating drum, the drum is typically heated to improve compatibility of the rotating drum with the inks deposited on the drum. The rotating drum can be, for example, an anodized and etched aluminum drum. A heater reflector or housing can be mounted axially within the drum and extends substantially from one end of the drum to the other end of the drum. A heater unit includes two heaters located within the heater reflector with each one being located approximately at each end of the reflector. The heater reflector remains stationary as the drum rotates. Thus, the heaters apply heat to the inside of the drum as the drum moves past the heaters backed by the reflector. The reflector helps direct the heat towards the inside surface of the drum. Each of the heaters is operatively connected to a controller which is configured to control the amount of power applied to the heaters for generating heat. The controller is also operatively connected to temperature sensors located near the outside surface of the drum. The controller selectively operates the heaters to maintain the temperature of the outside surface within an operating range.

In one embodiment, the controller is configured to operate the heaters in an effort to maintain the temperature at the outside surface of the drum in a range of about 55 degrees Celsius, plus or minus 5 degrees Celsius. The ink that is ejected onto the print drum has a temperature of approximately 110 to approximately 120 degrees Celsius. Thus, images having areas that are densely pixelated, can impart a substantive amount of heat to a portion of the print drum. Additionally, the drum experiences convective heat losses as the exposed surface areas of the drum lose heat as the drum rapidly spins in the air about the heater. Also, contact of the recording media with the print drum affects the surface temperature of the drum. For example, paper placed in a supply tray has a temperature roughly equal to the temperature of the ambient air. As the paper is retrieved from the supply tray, it moves along a path towards the transfer nip. In some printers, this path includes a media pre-heater that raises the temperature of the media before it reaches the drum. These temperatures can be approximately 40 degrees Celsius. Thus, when the media enters the transfer nip, areas of the print drum having relatively few drops of ink on them are exposed to the cooler temperature of the media. Consequently, densely pixilated areas of the print drum are likely to increase in temperature, while more sparsely covered areas are likely to lose heat to the passing media. These differences in temperatures result in thermal gradients across the print drum.

Efforts have been made to control the thermal gradients across a print drum for the purpose of maintaining the surface temperature of the print drum within the operating range.

Simply turning the heaters on and off can be insufficient because the ejected ink can raise the surface temperature of the print drum above the operating range, even when an individual heater is turned off. In some cases cooling is provided by adding a fan at one end of a print drum. The print drum is open at each end of the drum. To provide cooling, the fan is located outside the print drum and is oriented to blow air from the end of the drum at which the fan is located to the other end of the drum where it is exhausted. The fan is electrically operatively connected to the controller so the controller activates the fan in response to one of the temperature sensors detecting a temperature exceeding the operating range of the print drum. The air flow from the fan eventually cools the overheated portion of the print drum at which point the controller deactivates the fan.

While the fan system described above can generally maintain the temperature of the drum within an operating range, some inefficiencies do exist. Specifically, one inefficiency can arise when the surface area at the end of the print drum from which the air flow is exhausted has a higher temperature than the surface area near the end of the print drum at which the fan is mounted. In response to the detection of the higher temperature, the controller activates the fan. As the cooler air enters the drum, it absorbs heat from the area near the fan that is within the operating range. This cooling can result in the controller turning on the heater for that region to keep that area from falling below the operating range. Even though the air flow is heated by the region near the fan and/or the heater in that area, the air flow can eventually cool the overheated area near the drum end from which the air flow is exhausted. Nevertheless, the energy spent warming the region near the fan and the additional time required to cool the overheated area with the warmed air flow from the fan adds to the operating cost of the printer. Thus, improvements to printers to heat and to cool a print drum are desirable.

SUMMARY

A heated drum assembly for use in a printer includes a ceramic heater to direct heat and a slot cooler to direct cooling air to an internal surface of an imaging drum. The heated drum assembly includes an imaging hollow drum having an internal surface defining an internal cavity. The hollow drum includes a first end, a second end, and a longitudinal axis. A heater is located in the internal cavity of the hollow drum to heat the internal surface. The heater includes a first ceramic heating element and a cooler, located in the internal cavity of the hollow drum to cool the internal surface. The cooler includes a first applicator disposed adjacent to the internal surface.

A printer includes an image receiving member, a heater and a cooler disposed within the image receiving member. The heater includes a ceramic foam heater and a slot cooler to direct cooling air to an internal surface of the image receiving member. The printer includes an image receiving member having a substantially cylindrical outer surface and an internal surface defining an internal cavity. The image receiving member includes a first end, a second end, and a longitudinal axis. At least one ceramic heating element is located in the internal cavity, to heat the internal surface of the image receiving member. A cooler is located in the internal cavity to cool the internal surface. The cooler includes a first aperture disposed adjacent to the internal surface. A printhead is configured to deposit ink on the image receiving member wherein the printhead is disposed adjacent to the image receiving member. A controller is operatively connected to the heater, the cooler, and the printhead. The controller is configured to control the application of heat to the internal surface by the heater, to control the application of cooling to the internal surface by the cooler, and to control the printhead to deposit ink on the image receiving member during one of the application of heat and the application of cooling.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The foregoing aspects and other features of an inkjet printer rotating image receiving member that is heated to a predetermined temperature prior to receiving and during receipt of ink images are explained in the following description, taken in connection with the accompanying drawings.

DETAILED DESCRIPTION

Figure 1:
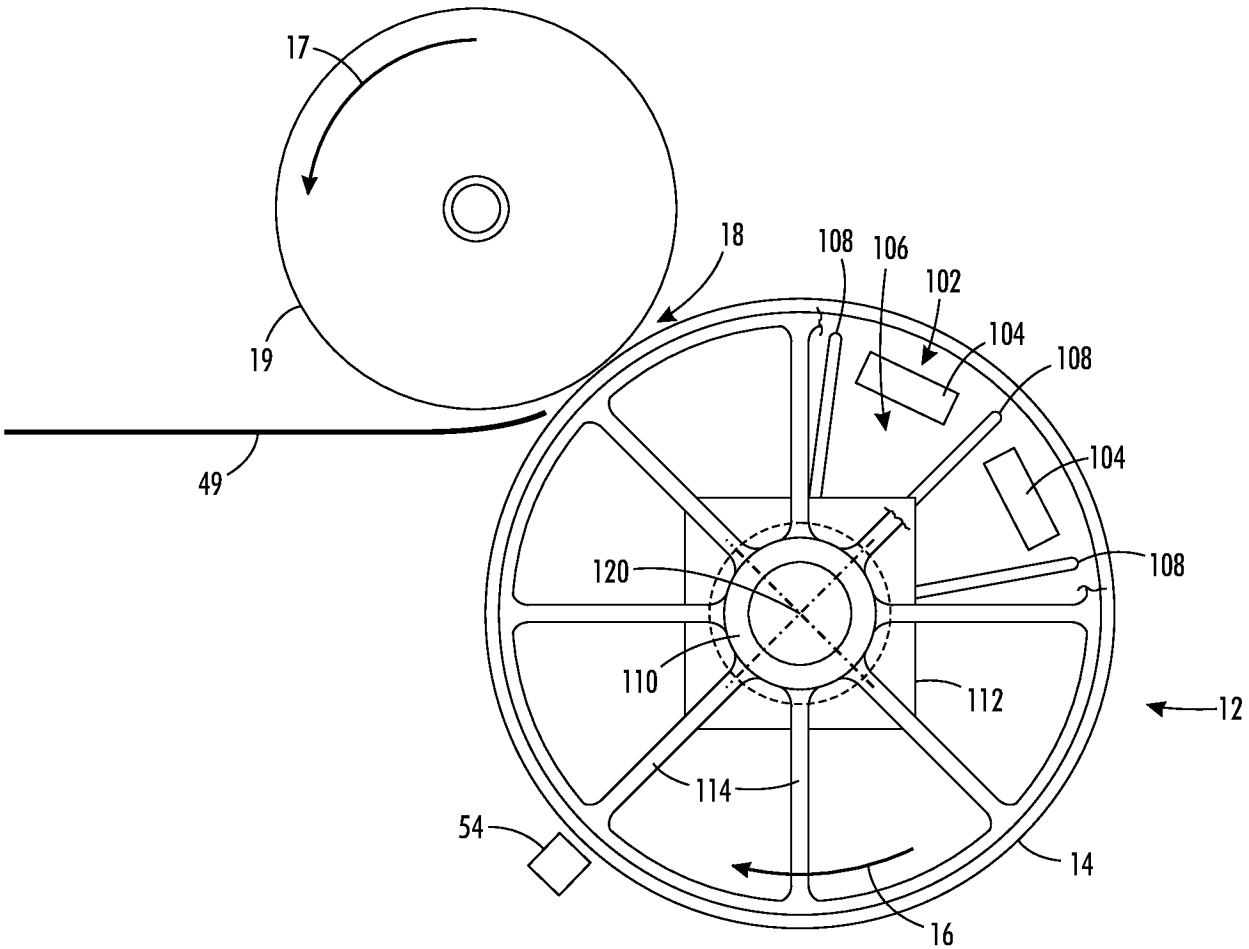
FIG. 1 is a side view of a portion of a printer including a transfix roller defining a nip with an image receiving member having a heater and a cooling system.

For a general understanding of the environment for the system and method disclosed herein as well as the details for the system and method, reference is made to the drawings. In the drawings, like reference numerals have been used throughout to designate like elements. As used herein the term "printer" refers to any device that produces ink images on media and includes, but is not limited to, photocopiers, facsimile machines, multifunction devices, as well as direct and indirect inkjet printers. An image receiving surface refers to any surface that receives ink drops, such as an imaging drum, imaging belt, or various recording media including paper.

Figure 5:
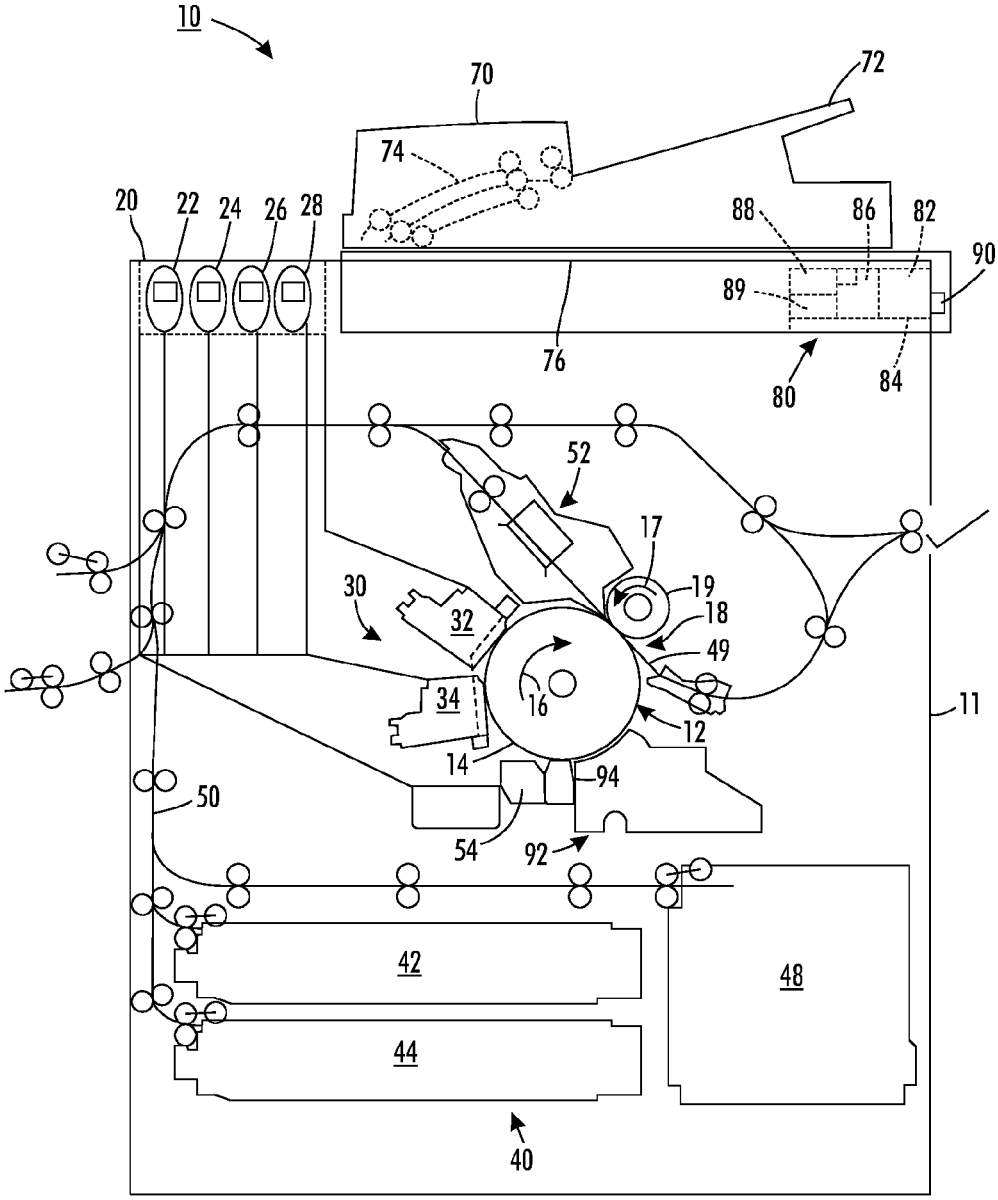
FIG. 5 is a schematic view of an inkjet printer configured to print images onto a rotating image receiving member and to transfer the images to recording media.

FIG. 5 illustrates a prior art high-speed phase change ink image producing machine or printer 10. As illustrated, the printer 10 includes a frame 11 supporting directly or indirectly operating subsystems and components, as described below. The printer 10 includes an image receiving member 12 that is shown in the form of a drum, but can also include a supported endless belt. The image receiving member 12 has an imaging surface 14 that is movable in a direction 16, and on which phase change ink images are formed. A transfix roller 19, rotatable in the direction 1,7 is loaded against the surface 14 of drum 12 to form a transfix nip 18, within which ink images formed on the surface 14 are transfixed onto a recording media 49, such as a heated media sheet.

The high-speed phase change ink printer 10 also includes a phase change ink delivery subsystem 20 that has at least one source 22 of one color phase change ink in solid form. Since the phase change ink printer 10 is a multicolor image producing machine, the ink delivery system 20 includes four (4) sources 22, 24, 26, 28, representing four (4) different colors CYMK (cyan, yellow, magenta, black) of phase change inks.

The phase change ink delivery system also includes a melting and control apparatus (not shown) for melting or phase changing the solid form of the phase change ink into a liquid form. The phase change ink delivery system is suitable for supplying the liquid form to a printhead system 30 including at least one printhead assembly 32. Each printhead assembly 32 includes at least one printhead configured to eject ink drops onto the surface 14 of the image receiving member 12 to produce an ink image thereon. Since the phase change ink printer 10 is a high-speed, or high throughput, multicolor image producing machine, the printhead system 30 includes multicolor ink printhead assemblies and a plural number (e.g., two (2)) of separate printhead assemblies 32 and 34 as shown, although the number of separate printhead assemblies can be one or any number greater than two.

As further shown, the phase change ink printer 10 includes a recording media supply and handling system 40, also known as a media transport. The recording media supply and handling system 40, for example, can include sheet or substrate supply sources 42, 44, 48, of which supply source 48, for example, is a high capacity paper supply or feeder for storing and supplying image receiving substrates in the form of cut media sheets 49, for example. The recording media supply and handling system 40 also includes a substrate handling and treatment system 50 that has a substrate heater or pre-heater assembly 52. The phase change ink printer 10 as shown can also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 is operably connected to the image receiving member 12, the printhead assemblies 32, 34 (and thus the printheads), and the substrate supply and handling system 40. The ESS or controller 80, for example, is a self-contained, dedicated mini-computer having a central processor unit (CPU) 82 with electronic storage 84, and a display or user interface (UI) 86. A temperature sensor 54 is operatively connected to the controller 80. The temperature sensor 54 is configured to measure the temperature of the image receiving member surface 14 as the image receiving member 12 rotates past the temperature sensor 54. In one embodiment, the temperature sensor is a thermistor that is configured to measure the temperature of a selected portion of the image receiving member 12. The controller 80 receives data from the temperature sensor and is configured to identify the temperatures of one or more portions of the surface 14 of the image receiving member 12.

The ESS or controller 80, for example, includes a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead assemblies 32 and 34. As such, the ESS or controller 80 is the main multi-tasking processor for operating and controlling all of the other machine subsystems and functions, including the printing process discussed below.

The controller 80 can be implemented with general or specialized programmable processors that execute programmed instructions. The instructions and data required to perform the programmed functions can be stored in memory associated with the processors or controllers. The processors, associated memories, and interface circuitry configure the controllers to perform the processes that enable the printer to perform heating of the image receiving member, depositing of the ink, and DMU cycles. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

In operation, image data for an image to be produced are sent to the controller 80 from either the scanning system 76 or via the online or work station connection 90 for processing and output to the printhead assemblies 32 and 34. Additionally, the controller 80 determines and/or accepts related subsystem and component controls, for example, from operator inputs via the user interface 86, and accordingly executes such controls. As a result, appropriate color solid forms of phase change ink are melted and delivered to the printhead assemblies 32 and 34. Additionally, pixel placement control is exercised relative to the imaging surface 14 thus forming desired images per such image data, and receiving substrates, which can be in the form of media sheets 49, are supplied by any one of the sources 42, 44, 48 and handled by recording media system 50 in timed registration with image formation on the surface 14. Finally, the image is transferred from the surface 14 and fixedly fused to the image substrate within the transfix nip 18.

In some printing operations, a single ink image can cover the entire surface of the imaging member 12 (single pitch) or a plurality of ink images can be deposited on the imaging member 12 (multi-pitch). Furthermore, the ink images can be deposited in a single pass (single pass method), or the images can be deposited in a plurality of passes (multi-pass method). When images are deposited on the image receiving member 12 according to the multi-pass method, under control of the controller 80, a portion of the image is deposited by the printheads within the printhead assemblies 32, 34 during a first rotation of the image receiving member 12. Then during one or more subsequent rotations of the image receiving member 12, under control of the controller 80, the printheads deposit the remaining portions of the image above or adjacent to the first portion printed. Thus, the complete image is printed one portion at a time above or adjacent to each other during each rotation of the image receiving member 12. For example, one type of a multi-pass printing architecture is used to accumulate images from multiple color separations. On each rotation of the image receiving member 12, ink droplets for one of the color separations are ejected from the printheads and deposited on the surface of the image receiving member 12 until the last color separation is deposited to complete the image.

In some cases for example, cases in which secondary or tertiary colors are used, one ink droplet or pixel can be placed on top of another one, as in a stack. Another type of multi-pass printing architecture is used to accumulate images from multiple swaths of ink droplets ejected from the print heads. On each rotation of the image receiving member 12, ink droplets for one of the swaths (each containing a combination of all of the colors) are applied to the surface of the image receiving member 12 until the last swath is applied to complete the ink image. Both of these examples of multi-pass architectures perform what is commonly known as "page printing." Each image comprised of the various component images represents a full sheet of information worth of ink droplets which, as described below, is then transferred from the image receiving member 12 to a recording medium.

In a multi-pitch printing architecture, the surface of the image receiving member is partitioned into multiple segments, each segment including a full page image (i.e., a single pitch) and an interpanel zone or space. For example, a two pitch image receiving member 12 is capable of containing two images, each corresponding to a single sheet of recording medium, during a revolution of the image receiving member 12. Likewise, for example, a three pitch intermediate transfer drum is capable of containing three images, each corresponding to a single sheet of recording medium, during a pass or revolution of the image receiving member 12.

Once an image or images have been printed on the image receiving member 12 under control of the controller 80 in accordance with an imaging method, such as the single pass method or the multi-pass method, the exemplary inkjet printer 10 converts to a process for transferring and fixing the image or images at the transfix roller 19 from the image receiving member 12 onto the recording medium 49. According to this process, the sheet of recording medium 49 is transported by a transport under control of the controller 80 to a position adjacent the transfix roller 19 and then through a nip formed between the movable or positionable transfix roller 19 and image receiving member 12. The transfix roller 19 applies pressure against the back side of the recording medium 49 in order to press the front side of the recording medium 49 against the image receiving member 12. In some embodiments, the transfix roller 19 can be heated.

A pre-heater for the recording medium 49 is provided in the media path leading to the nip. The pre-heater provides the necessary heat to the recording medium 49 for subsequent aid in transfixing the image thereto, thus simplifying the design of the transfix roller. The pressure produced by the transfix roller 19 on the back side of the heated recording medium 49 facilitates the transfixing (transfer and fusing) of the image from the image receiving member 12 onto the recording medium 49.

The rotation or rolling of both the image receiving member 12 and transfix roller 19 not only transfixes the images onto the recording medium 49, but also assists in transporting the recording medium 49 through the nip formed between them. Once an image is transferred from the image receiving member 12 and transfixed to a recording medium 49, the transfix roller 19 is moved away from the image receiving member 12. The image receiving member 12 continues to rotate and, under the control of the controller 80, any residual ink left on the image receiving member 12 is removed by drum maintenance procedures performed at a drum maintenance unit (DMU) 92.

The DMU 92 can include a release agent applicator 94, a metering blade, and, in some embodiments, a cleaning blade. The release agent applicator 94 can further include a reservoir having a fixed volume of release agent such as, for example, silicone oil, and a resilient donor roll, which can be smooth or porous and is rotatably mounted in the reservoir for contact with the release agent and the metering blade. The DMU 92 is operably connected to the controller 80 such that the donor roll, metering blade and cleaning blade are selectively moved by the controller 80 into temporary contact with the rotating image receiving member 12 to deposit and distribute release agent onto and remove un-transferred ink pixels from the surface of the member 12.

The primary function of the release agent is to prevent the ink from adhering to the image receiving member 12 during transfixing when the ink is being transferred to the recording medium 49. The release agent also aids in the protection of the transfix roller 19. Small amounts of the release agent are transferred to the transfix roller 19 and this small amount of release agent helps prevent ink from adhering to the transfix roller 19. Consequently, a minimal amount of release agent on the transfix roller 19 is acceptable.

The image receiving member 12 has a tightly controlled surface that provides a microscopic reservoir capacity to hold the release agent. Too little release agent present in areas or over the entire image receiving member prevents transfer of the ink pixels to the recording media 49. Conversely, too much release agent present on the image receiving member 12 results in transfer of some release agent to the back side of the recording media 49. If the recording media 49 is then printed on both sides in duplex printing, some of the ink pixels may not adhere properly to the second side of the recording media 49. To combat these image defects, each DMU cycle selectively applies and meters release agent onto the surface of the image receiving member 12 by bringing the donor roller and then the metering blade of the release agent applicator 94 into contact with the surface of the image receiving member 12 prior to subsequent printing of images on the image receiving member 12 by the printheads in assemblies 32, 34. These actions replenish the release agent to the reservoir on the surface of the image receiving member 12 to prevent image failure and ensure continued application of a uniform layer of release agent to the surface of the image receiving member 12.

In one embodiment of a solid ink printer, the image receiving member includes a diameter of approximately 21.75 inches which can image sheets of recording media at 250 sheets per minute. The drum is approximately 19 millimeters thick and includes a heater within the drum to maintain the external surface of the drum at or near 54 degrees Celsius for proper imaging of the ink and subsequent transfer to the paper. The thermal mass of the drum includes a very long time constant. Printheads are maintained at approximately 115 degrees Celsius and spaced from the external surface of the drum approximately 0.5 millimeters.

Referring now to FIG. 1, the prior art printer system 100 is modified to include a heater 102 and a cooling system 106 and to operate a heating and cooling method as described herein. FIG. 1 is a side view of a portion of the printer 10 including the image receiving member 12, with the imaging surface 14 rotating in the direction 16, and the transfix roller 19 rotating in the direction 17. The image receiving member 12 includes the heater 102 having one or more heating elements 104 and the cooling system 106 having one or more cooling members 108. The heater 102 and the cooling system 106 remain fixed as drum 12 rotates past the heater 102 and the cooling system 106. The heater 102 generates heat that is absorbed by the black painted inside surface of the drum 12 to heat the image receiving surface of the drum as it rotates past the heater. The cooling system 106 for the drum 12 includes a hub 110 that is preferably centered about the longitudinal center line or rotational axis 120 of the image receiving member 12. A fan 112 is mounted outboard of the hub 110 and oriented to direct air flow through the drum. The temperature sensor 54 is located adjacent to the outer surface of the drum 12 to detect the temperature of the drum surface as it rotates. As used herein, the term "cooler" or "cooling system" shall apply to any structure specifically useful for drawing thermal energy from or directing thermal energy away from a section of the drum. The structure of the cooler can have passive or active aspects, and structure within or beyond the drum assembly, to achieve this purpose.

Each end of the drum 12 can be open at the hub 110 at a plurality of spokes 114 as shown in FIG. 1. The hub can be provided with a pass through for passage of electrical wires to the heater(s) within the drum. Additionally, the hub has a bearing at its center so the drum 12 can be rotatably mounted in a printer. The spokes 114 extend from the hub 110 to support the cylindrical wall of the drum 12 and to provide airways for air circulation within the drum 12. The fan 112 can be a blower fan or other conventional electrical fan. The fan can also be a 3 phase AC fan. To generate maximum cooling the blower pushes air into the slot cooler and inpinges on the inside of the drum. In one embodiment, the fan 112 can produce air flow in the range of approximately 120 cubic feet per minute (CFM) of air flow, although other airflow ranges can be used depending upon the thermal parameters of a particular application. For instance, the thickness of the drum and the amount of ink deposited on the external surface can affect the amount of heat retained by the drum. The type of fan 112 can therefore be selected to provide the desired amount of cooling. The temperature sensor 54 can be any type of temperature sensing device that generates an analog or digital signal indicative of a temperature in the vicinity of the sensor. An additional sensor (not shown) can be located at the end of the drum 12 which is opposite the illustrated end at which sensor 54 is located. Such sensors can include, for example, thermistors or other junction devices that predictably change in some electrical property in response to the absorption of heat. Other types of sensors include infrared (IR) thermopile or contact thermistors.

Voids between the spokes 114 at each end of the drum 12 facilitate aft flow exiting through the drum 12. Additional temperature sensors can be mounted about the drum 12. The temperature sensors, however, are preferably mounted in a linear arrangement along a plane extending from the longitudinal axis 120 as shown in FIG. 1. Although the temperature sensors can be located near the ends (or edges) of the drum 12, temperature sensors can also be located closer towards the center of the drum. The drum 12 exhibits a temperature gradient from the middle to the edges of the drum, where the temperature at the middle is higher than at the edges. Each of the heaters 104 includes an internal flux gradient built into the material to compensate for the edges of the drum being cooler than the middle. The slot cooler also has a higher velocity in the middle which results in a higher heat transfer coefficient. The 19 mm wall acts to reduce the gradient because of the high thermal diffusivity of aluminum thus reducing the required optimization of the edges of both the heater flux and the slot air flow. The edgewise gradients can include a gradient of approximately three (3) degrees C. The ceramic heater 104 includes a material formed to provide an internal flux gradient that can compensate for the drum 12 being cooler at the edges than at the middle. The flux gradient of the heater 104 can be adjusted depending on the heat dissipation of the drum 12 and the overall system. In one embodiment, the material of the heater can include an austenitic nickel-chromium based alloy. One such material is known as Iconel® available from Special Metals Corporation, New Hartford, N.Y. Suitable ceramic heaters can be provided by Thermal Circuits Inc., Salem, Mass. The heat flux gradients are designed by altering the shape and width of the sine wave pattern in the artwork, free space versus artwork ratio, thickness of the ceramic material to manage changes in local resistances while keeping the max flux below 50 watts/inch$^2$ to avoid circuit damage.

The signals from the temperature sensors, such as sensor 54, can be analog signals that are digitized by an A/D converter, which is interfaced to the controller 80. The controller 80 receives temperature values from the temperature sensors and compares those values to thresholds using programmed instructions. In one embodiment, two temperature values can be used to generally determine the temperature along a longitudinal direction of the surface of the drum 12. The controller 80, which is operatively connected to the sensors, can be configured to adjust the temperature of the surface 14 of the drum 12, by applying additional heat to the internal surface of the drum, by removing heat from the internal surface of the drum 12 by reducing or turning off the heat applied by the heater 102, or by cooling the internal surface of the drum 12 by adjusting the amount of cooling delivered by the cooling system 106. Once the operation of the heater 102 and the cooling system 106 adjusts the temperature of the drum to the desired temperature, the controller turns off both the heater 102 and the cooling system 106. The controller 80 continues to monitor the temperatures supplied by the temperature sensors. Should the temperature of the external surface 14 of the drum 12 fall outside predetermined limits, the controller 80 adjusts the heat provided by the heater 102, the cooling provided by the cooling system 106, or both.

Figure 2:
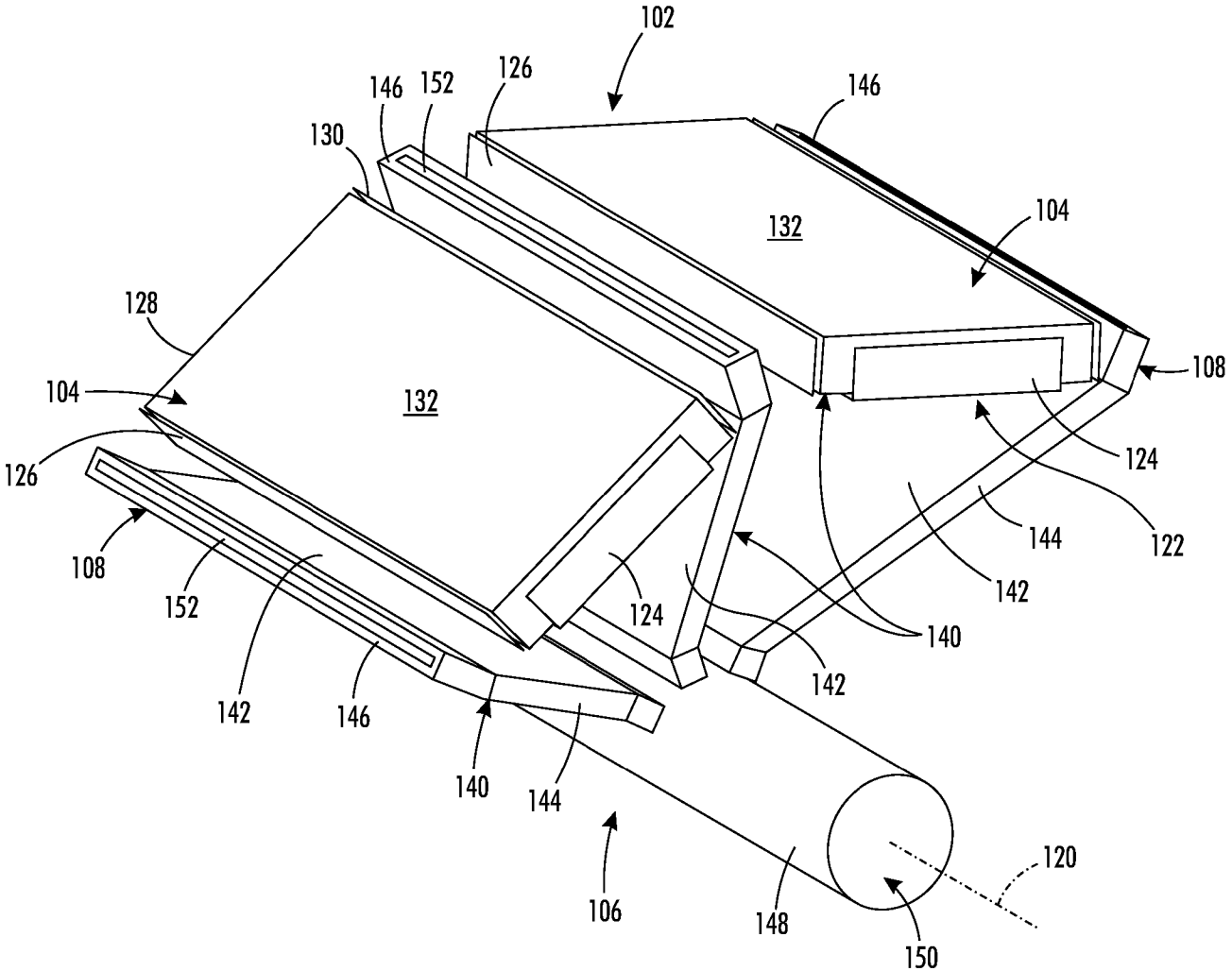
FIG. 2 is a perspective view of the heater and cooling system of FIG. 1.

A partial perspective view of the heater 102 and the cooling system 106 is shown in FIG. 2. The drum 12 is not illustrated (see FIG. 1). As further illustrated in FIG. 2, heating elements 164, and 134E each include a ceramic foam block, or a ceramic foam plate, generally having a shape defined as a right rectangular prism. Ceramic foam typically includes a cellular structure formed by filling the cells of an open cell polymer foam with a ceramic slurry. Once the slurry has migrated into the cells, the polymer foam is fired in a kiln leaving only the ceramic material. Ceramic foams can include different types of ceramic material, including aluminum oxide.

Each ceramic foam block is supported by a support structure 122 including first, second, third, and fourth sides 124, 126, 128, and 130. Each of the sides 124, 126, 128, and 130 includes a portion (not shown) extending beneath and supporting the ceramic foam block from underneath. The sides 124, 126, 128, and 130 define a space sufficient to support the ceramic foam block in a stable position with respect to the internal surface of the drum 12 as rotation occurs. The ceramic foam block can be held by the sides 124, 126, 128, and 130 through a friction fit or the ceramic foam block can be secured to the sides with a fire resistant, high temperature, or heat resistant adhesive or tape. Other structures for support are also possible. Heating elements, which are not illustrated, are operatively connected to the ceramic foam block to apply heat to the ceramic block which disperses the heat to the internal surface of the drum 12. Each heating element 104 can be operatively connected to the controller 80 and the heat produced by each heating element can be individually controlled by the controller 80.

The sides 124, 126, 128, and 130 extend along a respective side of the ceramic foam block but do not extend over a top surface 132 of the foam block. Consequently, the entire top surface of the foam block 104 is disposed adjacently to the internal surface of the drum 12. (See FIG. 1) The right rectangular prism includes a length sufficient to extend substantially the entire width of the drum 12 from one set of spokes to the other set of spokes. While rectangular blocks are shown, other shapes of ceramic foam heating elements 104 are possible. For instance, while the ceramic foam heating element 104 is shown as a single piece, a plurality of individual ceramic foam pieces can used. In this case, ceramic foam pieces having a smaller rectangular cross-section and the same length as the illustrated foam heating element 104 can be included. In this particular embodiment, the individual ceramic foam pieces can be aligned in an arc to follow the arc of the internal surface of the drum 12. In this structure, the overall exposed heating surface of the heating element 104 can placed more closely to internal surface of the drum. While such a structure can provide some additional coupling of generated heat to the drum, because the heater 14 is located within the drum, most of the heat generated is coupled to the drum. In one embodiment for heaters having a planar surface, the coupling of radiant energy can be approximately 90 to 95%. Consequently, ceramic heaters having planar surfaces can be used, thereby avoiding additional costs which can be present with more complex structures. In one embodiment, each of the ceramic foam heating elements 104 is a 1500 watt heating element. The ceramic foam heating elements 104 include a low thermal mass which when turned off continues to add heat to the internal surface of the drum. Because the thermal mass of the heating elements 104 and the drum 12 are known, the retention of heat by the ceramic heating elements 104 and the drum 12 can be used to by the controller which can be configured to adjust the temperature of the external surface of the drum 12.

Even though the thermal mass of the drum 12 and the heating elements 104 are known and can be used to determine the temperature of the external surface of the drum, the ink ejected onto the drum can also affect drum temperatures. The ink ejected onto the print drum has a temperature of approximately 110 to approximately 120 degrees Celsius which is sufficient to change the surface temperature of the drum 12. Thus, images having areas that are densely pixelated, can impart a sufficient amount of heat to change the surface temperature of a portion of the drum 12. Under these conditions, the drum 12 due to its thermal mass can retain the heat provided by the hot ink and can raise the temperature of the surface of the drum beyond that which is acceptable for imaging. To reduce the amount of heat being retained by the drum 12 as well as the heat being retained by the ceramic heating elements 104, a plurality of cooling members 108 are placed adjacently to the heating elements 104.

Each of the cooling members 108 includes a housing 140 having side walls 142, end walls 144, and a slotted wall 146. Each of the housings 140 includes an open end operatively connected to a conduit 148. The conduit 148 includes an open end 150 and a closed end (not shown) at an end of the conduit 148 opposite the open end 150. The open end provides an air inlet for receiving forced air from the fan 112 (See FIG. 1) or from a blower (not shown). The conduit also includes a plurality of openings (not shown), each of which is operatively connected to one of the housings 140 for the transfer of air from the fan 112 through the conduit 148 and into the housings 140. As used herein, the term "cooling member" or shah apply to any member disposed adjacent to the interior surface of the drum to apply or direct cooling, such as an applicator. The applicator can include the slotted wall 146 or other structure, such as nozzles or apertures, to achieve this purpose.

Each of the walls 142, 144, and 146 of one of the housings are operatively connected to define an internal space or passageway for directing forced air received from the fan 112 to the internal surface of the drum 12. The slotted wall 146 includes an aperture 152 generally defined as a slot having a length sufficient to extend substantially the width of the internal surface of the drum 12. Air provided by the fan 112 or blower enters the end 150, moves through the conduit into a respective housing 140 and out the slot 152. The slot can be considered as an air knife providing a "curtain" or "stream" of air which impinges upon the internal surface of the drum as a long relatively thin flow of air. The air stream is directed to the internal surface of the drum and aids in quenching the heating element 104 as well as providing a faster heating and cooling response. The slot 152 includes a width of approximately 2 millimeters. In one embodiment with a fan providing an air flow of approximately 120 cubic feet per minute, each of the slots 152 provides an air flow of approximately 40 cubic feet per minute. The slots 152 are located approximately four (4) millimeters from the internal surface of the drum.

The first, second, and third cooling members 108 direct a flow of air which is generally at a temperature relatively close to ambient temperature, since the fan or blower is located outside the internal space of the drum. A uniform flow of air is provided by each of the cooling members 108 to cool the internal surface of the drum 12 and thereby the external surface of the drum 12 though heat transfer. The air moving through the slots 152 includes a heat transfer coefficient of approximately h=938 for a gap of 4 mm, a slot 0.08 mm, a velocity of 5000 fpm, and a flow of 40 cfm/slot. The waste air then moves over the top surface 132 of each of the heater elements 104 to help quench the heat retained by the radiant ceramic heater elements 104. The ceramic foam heaters provide for the implementation of the natural gradients due to the end bell thermal load by changing the edge gradients of the heater to normalize the drum surface temperature as described above.

Figure 3:
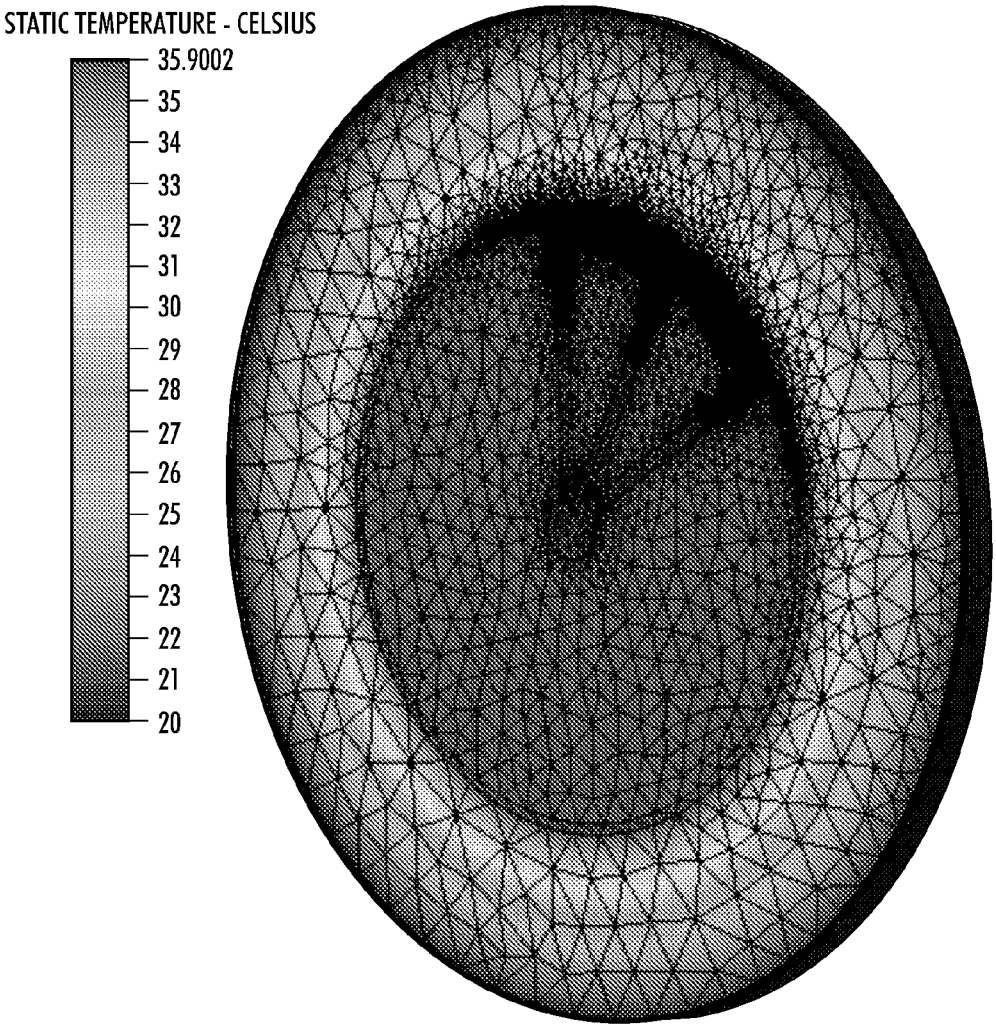
FIG. 3 is an image illustrating a thermal analysis of an image receiving member including the heater and cooling system at steady state.

FIG. 3 is an image illustrating a thermal analysis of an image receiving member including the heater and cooling system. In FIG. 3, a final drum temperature at steady state is illustrated with the printheads providing a constant convective flux load to the external surface of the drum 12 and with a wax applied to the surface. The cooling air provided by the slots 152 is approximately 30 degrees Celsius and is directed to the internal surface of the drum at 40 cubic feet per minute. The directed air flow from each of the three cooling members cools the surface of the drum to approximately 20 degrees Celsius. The cooler areas are illustrated in dark gray or black where the three cooling members are dark gray and a cooler area (black) in the shape of an arc abuts the interior surface of the drum.

Figure 4:
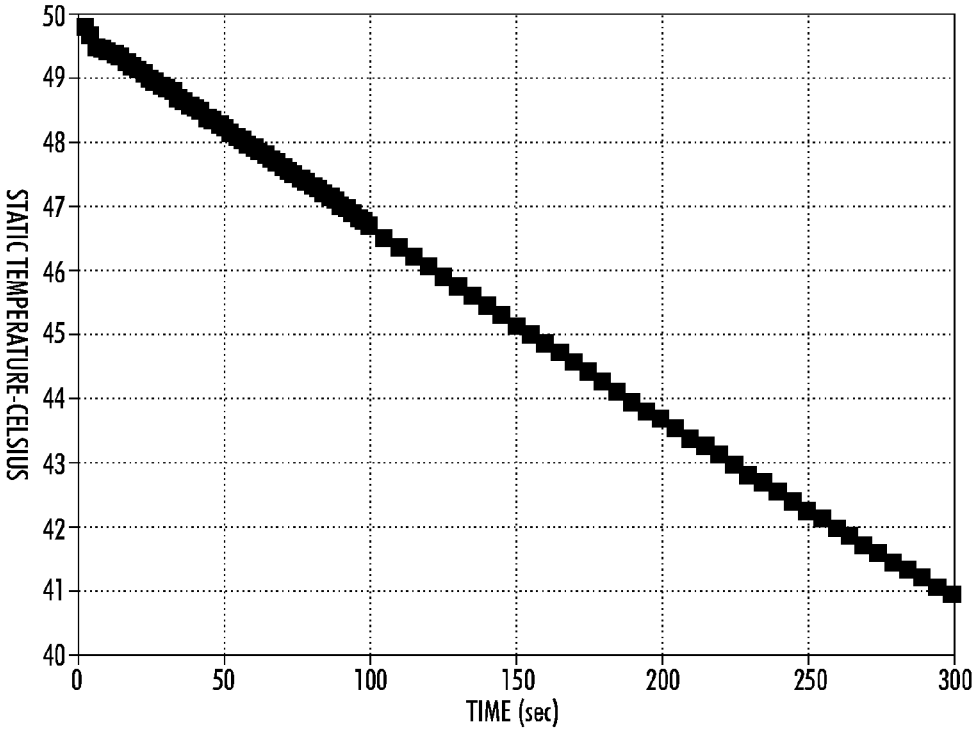
FIG. 4 is a graph of static temperature over time illustrating a cooling capability of a cooler disposed in an image receiving member.

FIG. 4 is a graph of static temperature in degrees Celsius over time illustrating a cooling capability of the cooler 106 disposed in an image receiving member. The cooling capability of the slots 152 can be seen as varying over time. Initially at zero seconds, the drum temperature at the external surface 14 of the drum 12 is approximately 50 degrees Celsius. Over a period of approximately three hundred seconds, the temperature of the surface 14 can be lowered approximately 8 to 9 degrees Celsius. The graph illustrates that sufficient cooling can be applied to the drum 12 to overcome normal printhead, paper, and ink loading temperatures directed to the drum during printing without adding any additional heat.

It will be appreciated that several of the above-disclosed and other features, and functions, or alternatives thereof, can be desirably combined into many other different systems or applications. Various presently unforeseen or unanticipated alternatives, modifications, variations, or improvements therein can be subsequently made by those skilled in the art, which are also intended to be encompassed by the following claims.

What is claimed is:

1. A heated drum assembly for use in a printer, the heated drum assembly comprising:

a hollow drum including an internal surface defining an internal cavity, the hollow drum having a first end and a second end and a longitudinal axis;

a heater located in the internal cavity of the hollow drum to heat the internal surface, the heater including a first ceramic heating element; and a cooler, located in the internal cavity of the hollow drum, the cooler having a first housing and at least one aperture that extends in a direction parallel to the longitudinal axis of the hollow drum to enable a stream of coolant to be directed toward the internal surface of the hollow drum in a direction normal to the internal surface.

2. The heated drum assembly of claim 1, the heater further comprising:

a second ceramic heating element disposed adjacent to the first ceramic heating element and defining a space between the first heating element and the second heating element, the housing of the cooler being located in the space.

3. The heated drum assembly of claim 2, the cooler further comprising:

a second housing having at least one aperture that extends in a direction parallel to the longitudinal axis of the hollow drum to enable a stream of coolant to be directed toward the internal surface of the hollow drum in a direction normal to the internal surface.

4. The heated drum assembly of claim 3, the cooler further comprising:

a third housing having at least one aperture that extends in a direction parallel to the longitudinal axis of the hollow drum to enable a stream of coolant to be directed toward the internal surface of the hollow drum in a direction normal to the internal surface.

5. The heated drum assembly of claim 4, the cooler further comprising:

a conduit configured to direct a flow of air into the first, the second, and the third housings that exits the at least one apertures of the first, the second, and the third housings.

6. The heated drum assembly of claim 5 wherein the at least one aperture of the first, the second, and the third housings is a slot.

7. The heated drum assembly of claim 6 wherein each of the first ceramic heating element and the second ceramic heating element defines a three dimensional volume having at least one surface directed toward the internal surface of the hollow drum.

8. The heated drum assembly of claim 7 wherein the first ceramic heating element and the second ceramic heating element define a rectangular prism with the at least one surface defining a planar surface.

9. The heated drum assembly of claim 5 further comprising:

a plurality of spokes radiating from a central hub and operatively connected to the hollow drum to support the central hub along the longitudinal axis of the hollow drum, the central hub being configured to support the conduit of the cooler.

10. The heated drum assembly of claim 9, the central hub further comprising:

a bearing to provide relative motion between the hollow drum and the cooler to enable the hollow drum to rotate with respect to the cooler.

11. A printer comprising:

an image receiving member including a substantially cylindrical outer surface and an internal surface defining an internal cavity, the image receiving member having a first end and a second end and a longitudinal axis, at least one ceramic heating element located in the internal cavity, to heat the internal surface of the image receiving member, and a cooler located in the internal cavity of the hollow drum, the cooler having a first housing and at least one aperture that extends in a direction parallel to the longitudinal axis of the hollow drum to enable a stream of coolant to be directed toward the internal surface of the hollow drum in a direction normal to the internal surface;

a printhead, to deposit ink on the image receiving member, the printhead disposed adjacent to the image receiving member; and a controller, operatively connected to the at least one ceramic heating element, the cooler, and the printhead, the controller being configured to control the application of heat to the internal surface by the at least one ceramic heating element, to control the application of cooling to the internal surface by the cooler, and to control the printhead to deposit ink on the image receiving member during one of the application of heat and the application of cooling.

12. The printer of claim 11, the at least one ceramic heating element further comprising:

a first ceramic heating element and a second ceramic heating element each being disposed adjacent to the internal surface of the image receiving member, the first ceramic heating element and the second ceramic heating element defining a space between the first ceramic heating element and the second ceramic heating element, and the first housing of the cooler is located in the space defined between the first ceramic heating element and the second ceramic heating element.

13. The printer of claim 12, the cooler further comprising:

a second housing having at least one aperture that extends in a direction parallel to the longitudinal axis of the hollow drum to enable a stream of coolant to be directed toward the internal surface of the hollow drum in a direction normal to the internal surface.

14. The printer of claim 13, the cooler further comprising:

a conduit configured to direct a flow of air into the first, the second, and the third housings that exits the at least one apertures of the first, the second, and the third housings.

15. The printer of claim 14 wherein the at least one aperture of the first, the second, and the third housings is a slot.

16. The printer of claim 14, the image receiving member further comprising:

a plurality of spokes radiating from a central hub and operatively connected to the image receiving member to support the central hub along the longitudinal axis of the image receiving member, the central hub being configured to support the conduit of the cooler.

17. The printer of claim 16, the central hub further comprising:

a bearing to provide relative motion between the image receiving member and the cooler to enable the substantially cylindrical outer surface to rotate with respect to the cooler.

18. The printer of claim 12, each of the first ceramic heating element and the second ceramic heating element further comprising:

a rectangular prism wherein the largest surfaces thereof are placed in closest proximity to the internal surface of the image receiving member.

19. The printer of claim 11, the controller being further configured to remove electrical power from the at least one ceramic heating element while maintaining air flow through the cooler.

* * * * *